US012104290B2

(12) United States Patent
Bertoli et al.

(10) Patent No.: US 12,104,290 B2
(45) Date of Patent: Oct. 1, 2024

(54) DEVICE FOR JOINING TEXTILE YARNS AND CORRESPONDING JOINING METHOD

(71) Applicant: HAYABUSA S.R.L., Preseglie (IT)

(72) Inventors: Luciano Bertoli, Fiume Veneto (IT); Gianni Mottola, Sacile (IT)

(73) Assignee: HAYABUSA S.R.L., Pordenone (IT)

( * ) Notice: Subject to any disclaimer, the term of this patent is extended or adjusted under 35 U.S.C. 154(b) by 0 days.

(21) Appl. No.: 17/766,573

(22) PCT Filed: Nov. 5, 2020

(86) PCT No.: PCT/IT2020/050270
§ 371 (c)(1),
(2) Date: Apr. 5, 2022

(87) PCT Pub. No.: WO2021/095072
PCT Pub. Date: May 20, 2021

(65) Prior Publication Data

US 2024/0102209 A1 Mar. 28, 2024

(30) Foreign Application Priority Data

Nov. 15, 2019 (IT) ..... 102019000021258

(51) Int. Cl.
*D01H 15/00* (2006.01)
*D01H 13/32* (2006.01)

(52) U.S. Cl.
CPC ..... *D01H 15/00* (2013.01); *D01H 13/32* (2013.01); *B65H 2701/31* (2013.01)

(58) Field of Classification Search
CPC ..... D01H 15/00; D01H 13/32; D01H 4/50; D01H 4/48; D01H 4/52; B65H 2701/31
USPC ..... 57/22, 23, 202, 261, 262, 263
See application file for complete search history.

(56) References Cited

U.S. PATENT DOCUMENTS 4,386,494 A * 6/1983 Felix ..... B65H 69/06 57/22
4,545,191 A * 10/1985 Bertoli ..... B65H 69/06 57/22
4,577,459 A * 3/1986 Speranzin ..... B65H 69/06 57/22
4,583,356 A * 4/1986 Badiali ..... B65H 69/06 57/22

(Continued)

FOREIGN PATENT DOCUMENTS

DE 10 2006 000 824 A1 7/2007
WO 2005/118449 A1 12/2005

OTHER PUBLICATIONS

Feb. 2, 2021 Search Report issued in International Patent Application No. PCT/IT2020/050270.

(Continued)

*Primary Examiner* — Bao-Thieu L Nguyen
(74) *Attorney, Agent, or Firm* — Oliff PLC

(57) ABSTRACT

A device for joining textile yarns for joining two ends of two textile yarns by decomposition and subsequent re-composition of the twists of the fibers of the ends in order to make up a single yarn, including two counter-rotating components, each provided with at least one joining element and disposed opposite each other defining a joining zone defined by the area between the respective joining elements facing each other and substantially aligned along a work axis.

13 Claims, 8 Drawing Sheets

(56) References Cited

U.S. PATENT DOCUMENTS

| | | | | |
|---|---|---|---|---|
| 4,590,753 | A * | 5/1986 | Bertoli | B65H 69/06 57/22 |
| 4,637,205 | A * | 1/1987 | Badiali | B65H 69/06 57/22 |
| 4,964,267 | A * | 10/1990 | Oehy | D01H 9/005 57/22 |
| 6,170,247 | B1 * | 1/2001 | Ragnoli | B65H 69/063 57/22 |
| 6,339,921 | B1 * | 1/2002 | Lassmann | D01H 4/50 57/22 |
| 9,873,959 | B2 * | 1/2018 | Stephan | D01H 15/00 |
| 2014/0360151 | A1 * | 12/2014 | Meyer | D01H 4/44 57/308 |

OTHER PUBLICATIONS

Feb. 2, 2021 Written Opinion of the International Searching Authority issued in International Patent Application No. PCT/IT2020/050270.

* cited by examiner (STATE OF THE ART)

F1
F2
X
G
10
11a
11b
12
12a
12b
13
14
15
16
17
18
19
19a
20
21
22
23
24
25
26
27
28
28a
28b
29
30
31
33
34
36
37
42
43
44
45
46
47

11b
12
43
45
37
36
47
F1
F2

X
13
22
26
25
21
33
27
44
29
11b
G
11a
28b
14
34
30
24
23
31
10

11a
42
12
45
F1
F2
37
36

19a
17
19b
18
11b
15
12b
G
16
12
11a
20
12a

DEVICE FOR JOINING TEXTILE YARNS AND CORRESPONDING JOINING METHOD

FIELD OF THE INVENTION

Embodiments described here concern a device for joining textile yarns. In particular, the device is used to carry out the stable joining of the ends of two textile yarns by means of the total or partial decomposition of the twists of a terminal segment defined by both the textile yarns, and the re-composition of the yarn with said combined ends.

The present invention also concerns a method for joining textile yarns.

BACKGROUND OF THE INVENTION

Joining devices are known, which eliminate the twists present in the end parts of two textile yarns, couple them and reconstitute the twists so as to create a single continuous yarn without interruptions, of the desired length, and without significant variations in the size of the area where the join is present.

In particular, joining devices are known, which decompose and re-compose the twist by means of two counter-rotating components coupled together in which the ends of the yarns to be joined are inserted.

For example, U.S. Pat. No. 4,637,205 is known, which provides a joining device, using two counter-rotating components facing each other, between which the ends of two yarns to be joined are interposed, positioned axially and adjacent and also opposite. These components are configured to rotate at the desired distance from each other, and in relation to the interposed textile yarns, in opposite directions, and to exert a desired pressure, one toward the other, to first eliminate the twists and then to align the fibers of the two ends, subsequently inverting the directions of rotation, in order to re-compose a single yarn by twisting together the combined and effectively parallelized fibers of the two textile yarns to be combined.

However, since it is completely mechanical, for example driven by cam mechanisms or suchlike, the device has a large number of components and a consequent complicated and slow actuation.

This means a long time is needed to join the textile yarns and leads to a consequent low productivity of the joining device itself, creating considerable downtimes in the apparatus for producing textile yarns with which the device can be associated.

Furthermore, given the large number of components of the device, maintenance operations are burdensome in terms of time and cost, also leading to long downtimes of the device and a consequent further reduction in productivity.

Furthermore, U.S. Pat. No. 4,637,205 also describes a method for joining opposite ends of two textile yarns by means of decomposition and subsequent re-composition of the twists of the end fibers to form a single yarn. This method is shown schematically and by way of example in FIGS. 1*a*-1*e* and provides:

- to introduce the yarns F1, F2 to be joined between two components 111 of a known device 110 (FIG. 1*a*),
- to bring the yarns F1, F2 close between the components 111 of the known device 110 by means of a counter-rotation R of the components 111 (FIG. 1*b*),
- to remove the end parts of the yarns F1, F2 that will not contribute to the joining (FIG. 1*c*) by means of removal means 113,

- to move close and overlap the ends of the yarns F1, F2 to be joined by mechanical approach means 112 (FIG. 1*d*),
- to perform another counter-rotation R to twist the ends of the overlapping yarns F1, F2 to be joined (FIG. 1*e*).

However, since it is obtained by means of known devices, this method entails long joining times and consequent high costs.

Furthermore, this method does not guarantee an optimal joining of the yarns.

Other joining systems known in the state of the art are described in documents DE-A-102006000824, which concerns a known device for joining yarns in a textile machine and U.S. Pat. No. 4,386,494, which concerns a method and apparatus for joining bundles of fibers, as produced in the textile industry.

Known joining devices, mainly of the mechanical type, are therefore complex, have a large number of components and are difficult to install and adapt to different spoolers.

There is therefore a need to perfect a device for joining textile yarns which can overcome at least one of the disadvantages of the state of the art.

In particular, one purpose of the present invention is to provide a device for joining textile yarns which allows to increase productivity by joining two consecutive yarns rapidly and at the same time producing a continuous, good-quality yarn.

It is also a purpose of the present invention to provide a device for joining textile yarns which has simplified maintenance.

It is also a purpose of the present invention to provide a device for joining textile yarns which is versatile, and which can also be installed on different spoolers.

It is also a purpose of the present invention to perfect a method for joining two yarns that is fast and efficient.

The Applicant has devised, tested and embodied the present invention to overcome the shortcomings of the state of the art and to obtain these and other purposes and advantages.

SUMMARY OF THE INVENTION

The present invention is set forth and characterized in the independent claims. The dependent claims describe other characteristics of the present invention or variants to the main inventive idea.

In accordance with the above purposes, the present invention concerns a device for joining textile yarns for joining opposite ends of two textile yarns by means of decomposition and subsequent re-composition of the twists of the fibers of the ends in order to make up a single yarn.

In the present invention, a textile yarn is intended as a yarn made up of a plurality of fibers of animal, vegetable and/or synthetic origin.

In the case of synthetic fibers, there can be yarns with grouped and twisted fibers. Such yarns can provide an elastic inner core yarn, in the case of applications in partly or totally elasticized fabrics.

The joining device comprises two counter-rotating components.

The components are each provided with at least one joining element.

The components are disposed opposite each other defining a joining zone between the respective joining elements facing each other and substantially aligned along a work axis.

According to one aspect of the invention, the joining device comprises one or more motor members configured at least to selectively move at least one of the components along the work axis, so as to adjust the width and size of the joining zone and to selectively rotate the components with respect to each other about the work axis to obtain the decomposition and subsequent re-composition of the twists of the fibers of the yarns.

Advantageously, the one or more motor members are electrically driven, allowing to automate the joining device, simplifying the drive, control and maintenance thereof and reducing the necessary bulk.

In particular, such one or more motor members are electric, preferably of the stepper or brushless type, or one of one type and one of the other. However, it is not excluded that such motor members are of the pneumatic type.

In addition, the motor members allow to reduce the number of mechanical components required to move the components toward each other and to rotate them, making the joining device more compact and lighter overall, and reducing its maintenance interventions and its complexity.

According to the invention, the device also comprises a control unit having an internal memory provided with a list of functioning parameters of the two components for joining the textile yarns and, therefore, for controlling the one or more motor members and everything associated therewith.

According to one aspect of the invention, the control unit is configured to control and command the one or more motor members on the basis of the functioning parameters present in the internal memory.

According to one variant, the control unit has means for processing data connected to the joining, which have the ability to intervene on such data and on the motor members that generate them.

At least one of the motor members can be equipped with a position transducer, or encoder; such control unit will be configured to command this at least one motor member as a function of such functioning parameters and of the values detected by such position transducer.

Advantageously, the control unit allows to completely automate the joining of the two textile yarns, reducing the joining times and optimizing the joint, while at the same time guaranteeing a continuous joined yarn of high quality. This control unit, provided for example with a stand-alone electronic card, can directly control each motor member. The present joining device also proves to be extremely versatile and can be installed on spoolers even of different types.

According to a first variant, the control unit stores each result obtained in terms of diameter and length of the join, and periodically updates the functioning parameters pre-recorded in the internal memory.

According to another variant, the control unit records each step of the activity of the joining device.

In this way, on the one hand, an always optimal functioning of the device is guaranteed, preventing anomalies in the functioning thereof and in the join obtained and, on the other hand, it becomes possible to analyze each cycle, evaluating every aspect of it.

For example, this control unit can perform device diagnostics after each join, and/or periodically, in order to dynamically self-regulate, preventing, even possibly by processing the data, the occurrence of the anomalies as above.

In particular, at least one motor member can have a receiving only encoder, however, according to one variant it can also be a dialoging encoder, in communication with the control unit, this to guarantee a better control of the behavior of the respective motor member.

According to one embodiment, the device comprises a first motor member configured to selectively move at least one of the two components along the work axis, and a second motor member configured to make the two components rotate with respect to each other, in opposite directions, about the work axis.

According to one variant, the joining device comprises a third motor member configured to drive retaining means suitable to keep the textile yarns in tension in the joining zone.

In particular, the control unit can suitably adjust the position of the retaining means as a function of the type of yarn and of the desired tension thereof inside the joining zone.

According to another variant, the joining device comprises a fourth motor member configured to drive removal means suitable to remove the end parts of the yarns not necessary for the joining, in order to prepare the two yarns for the joining operations.

The third motor member and/or the fourth motor member can be independent or derived from the first and/or the second motor member.

According to some embodiments, the joining device is equipped with a plurality of sensor means which cooperate with the motor members as above for the correct execution of the respective functions.

The present invention also concerns a method for joining opposite ends of two textile yarns by means of decomposition and subsequent re-composition of the twists of the fibers or filaments present in the end parts in order to make up a single yarn.

The joining method that is provided by the invention is known, as described, for example, but not only, in patent document U.S. Pat. No. 4,637,205 and comprises, as well as the known functions, those means that are intended to achieve the very same functions.

The known method comprises:

- introducing two textile yarns to be joined between two components, each provided with at least one joining element and disposed opposite each other defining a joining zone between the respective joining elements facing each other aligned along a work axis;
- bringing the two components close to each other along the work axis until there is at least partial contact between the facing joining elements;
- rotating the two components in opposite directions to each other so as to bring the two yarns close and parallel to each other in the joining zone;
- removing the end parts of the yarns that will not contribute to the joining, obtaining the opposite ends of the two textile yarns to be joined;
- bringing the ends of the two textile yarns to be joined close together until they substantially overlap;
- counter-rotating the two components in opposite directions to each other, so as to twist the two ends of the two textile yarns in order to create a single yarn.

According to one aspect of the invention, the method also comprises making available in an internal memory of a control unit a list of functioning parameters of the components for joining textile yarns.

According to one aspect of method in accordance with the invention, the control unit, as a function of the functioning parameters, commands and controls one or more motor members dedicated to executing one or more of said steps of introducing the textile yarns into the joining zone, bringing the two components close together, rotating the two components, removing the end parts of the textile yarns, bringing close together the ends of the textile yarns obtained and counter-rotating the two components.

By one or more motor members we mean, in particular, one or more of either the first, the second, the third or the fourth motor member as previously described.

However, it should be noted that there can be provided at least one motor member for each of the steps as above, or that one motor member can be designated to execute one or more or all of the steps.

Advantageously, the use of a control unit and of one or more motor members allows to obtain an efficient and completely automated joining method.

With the invention, it is possible to optimize, accelerate and improve the joining of the textile yarns, reducing downtime, as a non-limiting example, in production lines of textile yarns or in combination with a machine for working the yarn.

According to one embodiment, it is also provided to:

detect and monitor the movement of at least one of the components along the work axis;

detect the rotation of at least one of the components about the work axis during the rotation and counter-rotation.

In particular, the control unit commands and controls the functioning of the one or more motor members based on the functioning parameters stored in the internal memory, and on the basis of the parameters detected in the detections as above.

These detections allow to optimize the management of the one or more motor members, assigned to the steps as above, facilitating and improving the joining of the textile yarns.

The control unit can, therefore, control the correct execution of each of the steps as above and the results obtained in each one of them.

If the control unit detects an anomaly in the functioning of the device or in the resulting joined yarn, the control unit resets the device with new functioning parameters.

According to one variant, the control unit can be enabled to dialog, on each occasion or continuously, with a service processor that assists one or more joining devices.

BRIEF DESCRIPTION OF THE DRAWINGS

These and other aspects, characteristics and advantages of the present invention will become apparent from the following description of some embodiments, given as a non-restrictive example with reference to the attached drawings wherein:

FIGS. 4-8 are section views of the joining device of FIG. 3 in different conditions;

FIGS. 4*a*-8*a* and FIGS. 4*b*-8*b* are views of elements of the joining device in the respective conditions of use of FIGS. 4-8;

FIGS. 4*c*-8*c* are enlarged details of the joining device in the respective conditions of use of FIGS. 4-8;

To facilitate comprehension, the same reference numbers have been used, where possible, to identify identical common elements in the drawings. It is understood that elements and characteristics of one embodiment can conveniently be incorporated into other embodiments without farther clarifications.

DETAILED DESCRIPTION OF SOME EMBODIMENTS

We will now refer in detail to the possible embodiments of the invention, of which one or more examples are shown in the attached drawings. Each example is supplied by way of illustration of the invention and shall not be understood as a limitation thereof. It is understood that the present invention shall include all possible modifications and variants. We must also clarify that the phraseology and terminology used here is for the purposes of description only, and cannot be considered as limitative.

Figures 1A, 1B, 1C, 1D, 1E:
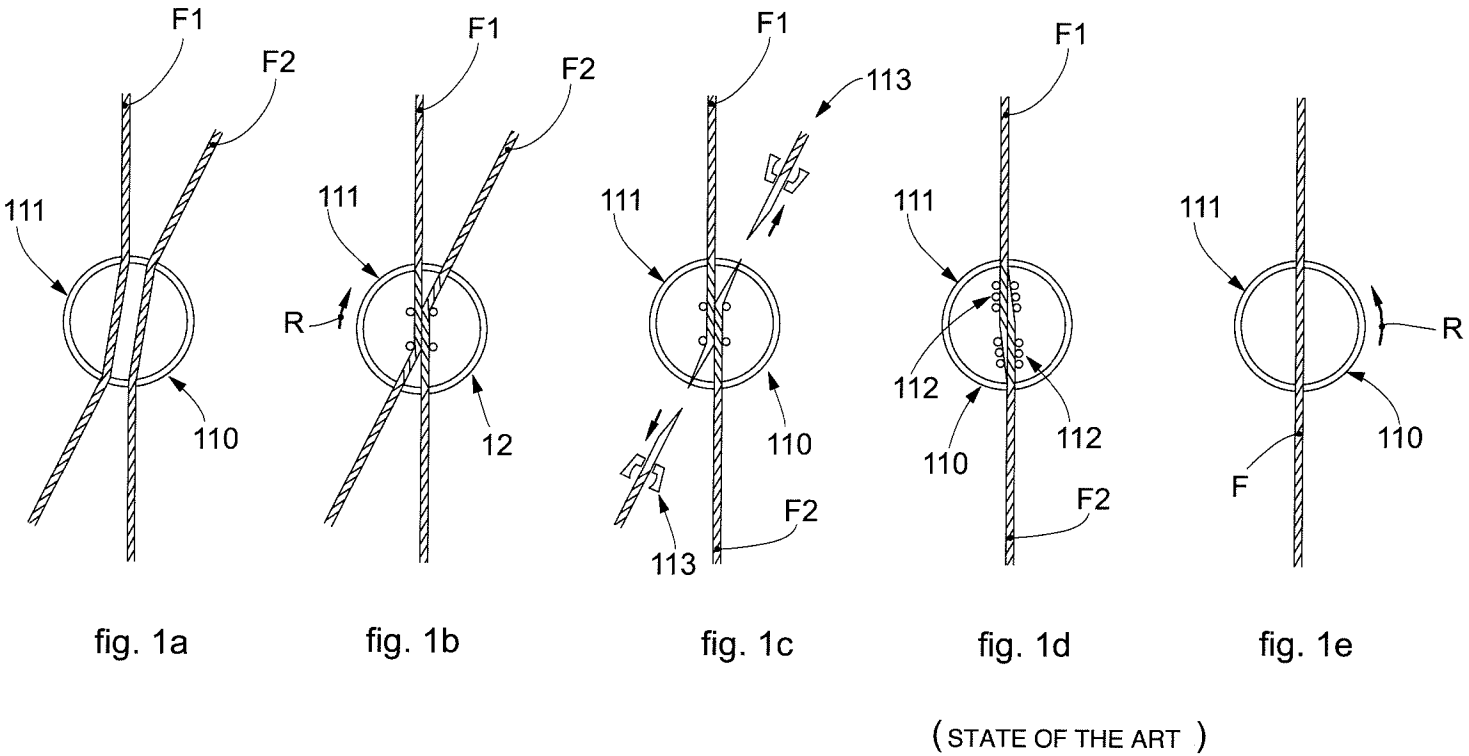
FIGS. 1*a-e* are schematic representations of a joining sequence of two textile yarns according to some embodiments in accordance with the state of the art.
Figure 3:
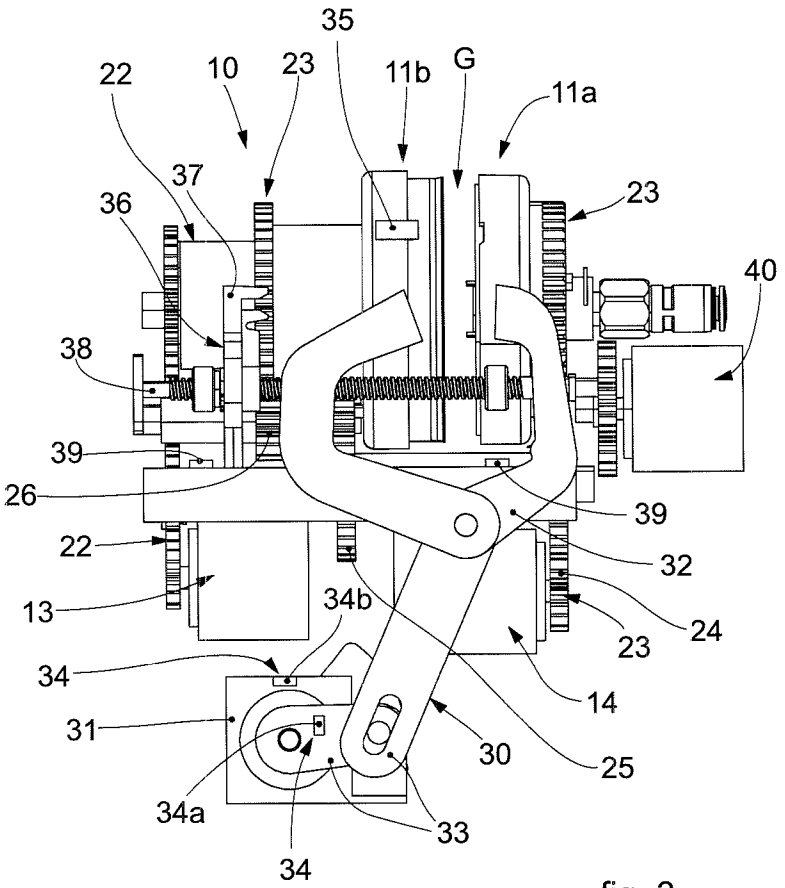
FIG. 3 is a front view of the joining device of FIG. 2.
Figure 2:
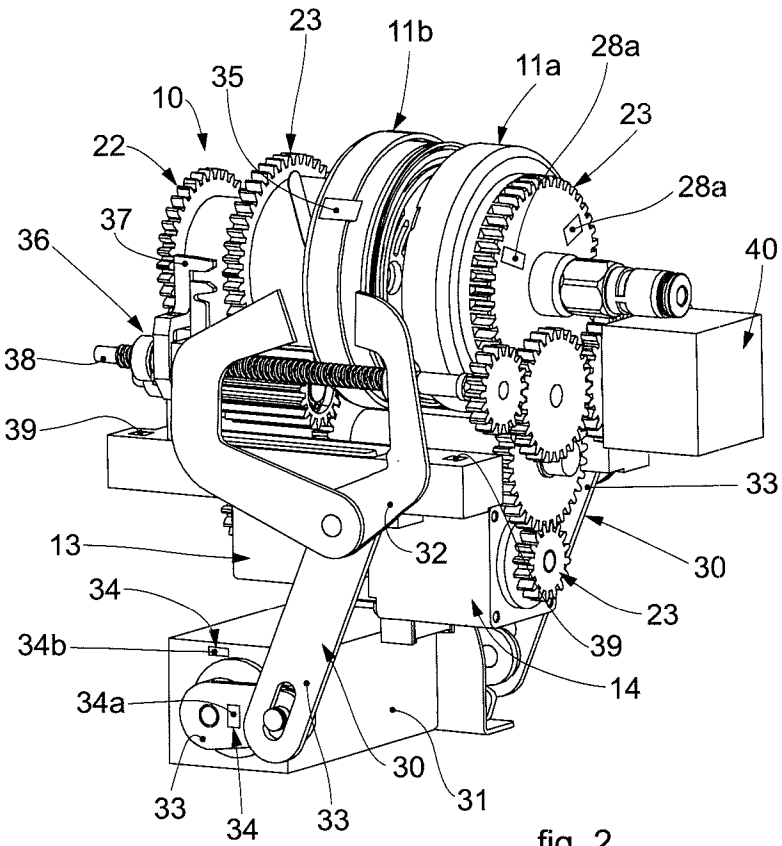
FIG. 2 is a perspective view of a joining device in accordance with the present invention.

With reference to FIGS. 2-3, there is shown, as a non-limiting example, a device 10 for joining textile yarns F1, F2 for joining the opposite ends of two textile yarns F1, F2 by means of decomposition and subsequent re-composition of the twists of the fibers of such ends in order to make up a single yarn F.

The device 10 comprises two counter-rotating components 11*a*, 11*b* disposed opposite each other.

Each component 11*a*, 11*b* comprises at least one joining element 12.

In particular, the two components 11*a*, 11*b* are disposed opposite each other so as to face the two respective joining elements 12, defining between them a joining zone G.

During use, two ends of two yarns F1, F2 which are to be joined are interposed between the two components 11*a*, 11*b*.

Each component 11 comprises a frame 17 having a housing seating 18 in which the joining element 12 is disposed, axially mobile.

Such joining element 12 can substantially have a plate or discoidal shape.

Each joining element 12 can comprise at least one support plate 15 and an upper plate 16 disposed above the support plate 15 and facing toward the outside of the housing seating 18.

In particular, the upper plate 16 can be totally or partly made of soft material, partly and elastically deformable.

Each component 11 comprises spring means 19 provided inside the housing seating 18 and associated on one side with the housing seating 18 and on the other side with the joining element 12.

In particular, the spring means 19 are configured to selectively move the joining element 12 axially with respect to the housing seating 18.

With reference to FIGS. 2-8, a first component 11*a* comprises bellows means 20 disposed between the housing seating 18 and the joining element 12, and configured to cooperate with the spring means 19 in the axial movement of the joining element 12 as above.

With reference to FIGS. 2-8, a second component 11*b*, disposed aligned facing the first component 11*a*, a circular joining element 12*a* and an annular joining element 12*b* which is concentric and external to the circular joining element 12*a*.

The second component 11*b* can comprise first spring means 19*a* associated with the circular joining element 12*a*, and second spring means 19*b* associated with the annular joining element 12*b* and independent of said first spring means 19*a*.

With reference to FIGS. 2-8, the annular joining element 12*b* protrudes above the circular joining element 12*a* and externally to the housing seating 18.

Each component 11*a*, 11*b* can comprise one or more guide pins 45 integral with the frame 17 to allow the correct sliding of the respective joining element 12 axially to the frame 11.

Furthermore, at least one component 11*a*, 11*b* can provide, in the respective housing seating 18, a centering pin 47 integral with the frame 17 and selectively protruding centrally to the joining element 12, following the movement of the latter toward the inside of the housing seating 18.

According to the invention, the device 10 comprises one or more motor members 13, 14, 31, 40 configured at least to selectively move at least one of the components 11*a*, 11*b* along the work axis X so as to adjust the width and size of the joining zone G and to selectively rotate the components 11*a*, 11*b* with respect to each other about the work axis X, in order to obtain the decomposition and subsequent re-composition of the twists of the fibers of the yarns F1, F2.

In particular, a first motor member 13 is configured to take at least one of the two components 11*a*, 11*b* into one or more positions of cooperation with the other component 11*a*, 11*b* along the work axis X.

By way of a non-limiting example, in FIGS. 2-8, a first component 11*a* and a second component 11*b* are associated with a support structure 21 and the second component 11*b* is mobile along the work axis X with respect to the first component 11*a* and to the support structure 21.

Figure 9:
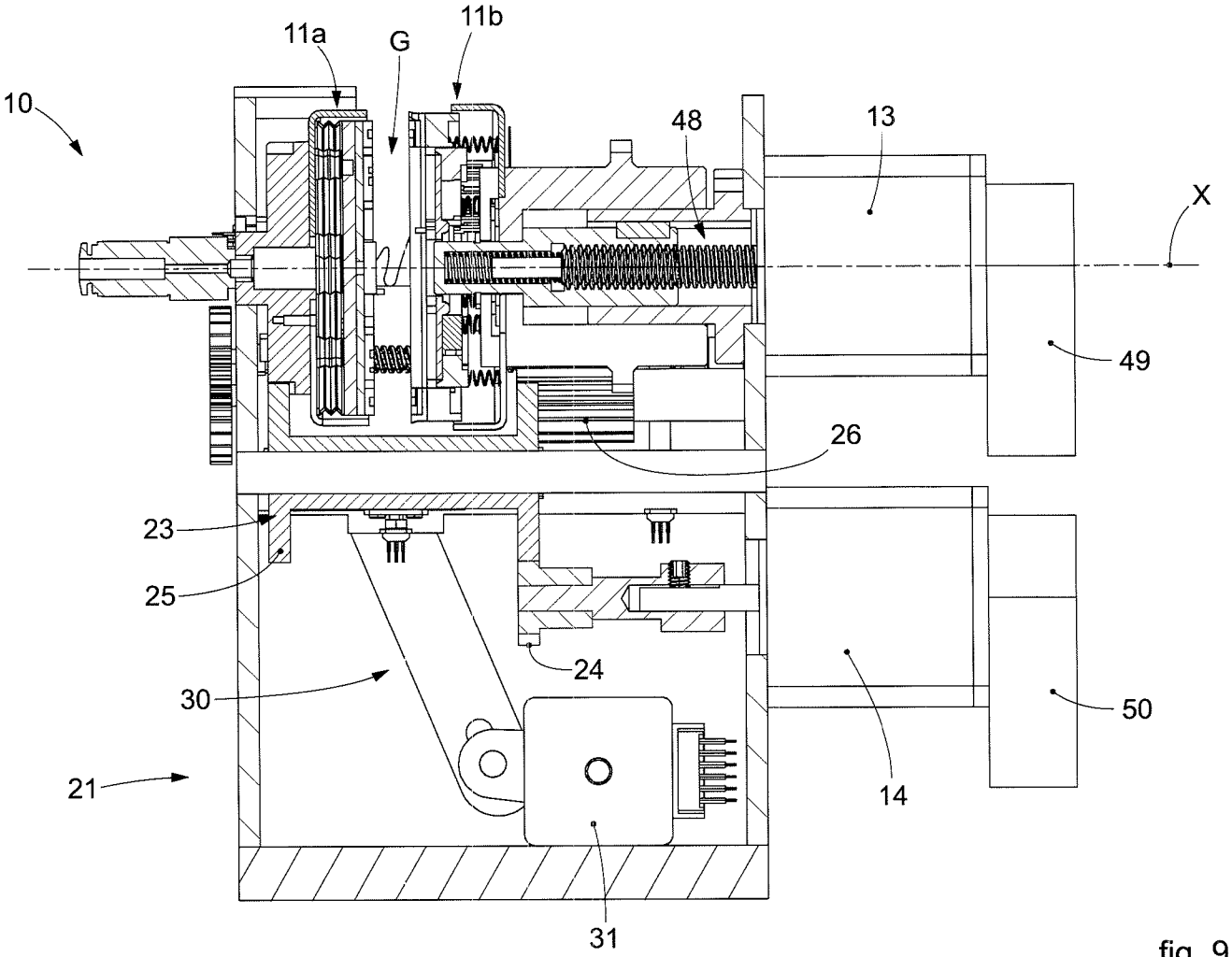
FIG. 9 is a section view of one variant of the present joining device.

The first motor member 13 can drive at least one transmission mechanism 22 comprising, as a non-limiting example, piston, rack and worm screw means, see for example the worm screw 48 of FIG. 9, and/or any other mean whatsoever able to impart a rectilinear translational motion to at least one of the components 11*a*, 11*b*.

According to one embodiment, a second motor member 14 is configured to make the two components 11*a*, 11*b* rotate with respect to each other, in opposite directions, about the work axis X in order to obtain the decomposition and subsequent re-composition of the twists of the fibers of the yarns F1, F2.

The second motor member 14 can drive movement means 23 comprising, as a non-limiting example, toothed wheels 24, 25, 26, belts and/or any other mean whatsoever able to impart the relative rotation of the two respective components 11*a*, 11*b*.

By way of a non-limiting example, with reference to FIGS. 4-8, the second motor member 14 rotates a toothed drive wheel 24 in one direction, which in turn rotates an intermediate element 25 configured to mesh on one side with the first component 11*a* and on the other side with at least one motion-inverting wheel 26, the latter being configured to mesh with the second component 11*b* so as to transmit a rotation which is always opposite to that of the first component 11*a*.

In this case, in order to invert the rotation of the two components 11*a*, 11*b*, the second motor member 14 inverts the rotation of the drive wheel 24.

According to the present invention, the device 10 comprises a control unit 29 having an internal memory 44 provided with a list of functioning parameters of two components 11*a*, 11*b* for joining yarns F1, F2. Such control unit 29 can comprise for example a stand-alone electronic card.

According to one embodiment, the functioning parameters comprise the speed of movement of the at least one component 11*a*, 11*b* along the work axis X, the rotation speed of the components 11*a*, 11*b*, the type of yarns F1, F2 to be joined, the thrust between the opposite components 11*a*, 11*b* and/or the contact area in the joining zone G between the opposite joining elements 12.

The functioning parameters can also comprise, but not be limited to, a list of positioning coordinates of the components 11*a*, 11*b* along the work axis X and of angles of rotation with respect to the latter as a function of the operation to be carried out and of the type of yarn F1, F2.

Such functioning parameters can be entered manually by an operator or automatically by a software system.

In particular, the memory 44 can provide a plurality of sets of functioning parameters, one set for each type of yarn to be joined.

By type of yarn we mean consistency, material, average length of the fibers that constitute it, diameter of the yarn and/or other similar or comparable characteristics.

In particular, the control unit 29 is configured to control and command the one or more motor members 13, 14, 31, 40 on the basis of the functioning parameters present in such memory 44.

This control unit 29 can be installed on the device 10, however, the device 10 could also be driven and controlled remotely.

According to one embodiment, the joining device 10 comprises first sensor means 27 configured to detect the movement of the two components 11*a*, 11*b* toward and/or away from each other.

As a non-limiting example, the first sensor means 27 can be of the magnetic or optical type, and/or any other type suitable to detect the movement of at least one component 11*a*, 11*b* along the work axis X.

By way of non-limiting example (FIGS. 4-8), the first sensor means 27 comprise at least one emitter provided on a component 11*b*, mobile along the work axis X, and a respective receiver associated with the support structure 21, provided fixed with respect to the work axis X. In this way, the receiver detects the distance from the emitter, as the second component 11*b* moves along the work axis X.

As a non-limiting example, the emitter can be a magnet and the receiver can be an induction sensor.

If both components 11*a*, 11*b* are mobile along the work axis X, an emitter can be provided on each component 11*a*, 11*b*.

According to one embodiment, the control unit 29 is configured to command the one or more motor members 13, 14, 31, 40 as a function of the functioning parameters and of the values detected by the first sensor means 27.

According to one embodiment, the joining device 10 comprises second sensor means 28 configured to detect the angle of rotation of at least one of the two components 11*a*, 11*b*.

As a non-limiting example, the second sensor means 28 can be of the magnetic or optical type, and/or any other type suitable to detect the rotation of the at least one component 11*a*, 11*b* about the work axis X.

By way of a non-limiting example, with reference to FIGS. 4-8, the second sensor means 28 can comprise at least one signaling device 28*a* provided integral on at least one component 11*a*, 11*b*, and at least one respective acquisition element 28*b* associated with the support structure 21, provided fixed with respect to the work axis X. In this way, the acquisition element 28*b* detects the distance from the signaling device 28*a*, as the component 11*a*, 11*b*, on which the signaling device 28*a* is installed rotates about the work axis X.

With reference to FIG. 2, the second sensor means 28 can comprise one or more signaling devices 28*a*, disposed angularly distanced on the component 11*a*, 11*b*, so that each signaling device 28*a*, in cooperation with the acquisition element 28*b*, identifies an angular position of the component 11*a*, 11*b*.

As a non-limiting example, a signaling device 28*a* can be a magnet or an element that produces a light beam, and the acquisition element 28*b* can be an induction or optical sensor respectively.

According to one embodiment, the control unit 29 is configured to command the one or more motor members 13, 14, 31, 40 as a function of the functioning parameters and of the values detected by the second sensor means 28.

In particular, the control unit 29 is configured to command the first motor member 13 and the second motor member 14 as a function of the functioning parameters and as a function of the values detected by the first sensor means 27 and by the second sensor means 28 respectively.

In this way, the control unit adjusts the distance between the two components 11*a*, 11*b* and the respective rotations in an extremely precise and rapid manner, acquiring the values detected by the first sensor means 27 and by the second sensor means 28 in real time, comparing them with the pre-stored functioning parameters and possibly, in case of inconsistencies, modifying the positions of the components 11*a*, 11*b* in real time so as to obtain a joined yarn of high quality.

According to one embodiment, the device comprises a third motor member 31 configured to drive retaining means 30 suitable to keep the yarns F1, F2 in tension in the joining zone G.

The retaining means 30 are mobile from an inactive position, in which they do not interfere with the joining zone G, to an operative position, on the opposite sides of the joining zone G, in which they cooperate with the components 11*a*, 11*b*.

In particular, the third motor member 31 is configured at least to move the retaining means 30 from the inactive position to the operative position.

Furthermore, the third motor member 31 can be configured to move the retaining means 30 so as to keep the yarn F1, F2 in tension inside the joining zone G.

The retaining means 30 can comprise a pair of pincers 32 configured to selectively retain the yarns F1, F2 and keep them in tension for the entire duration of the joining.

In particular, the pair of pincers 32 can be disposed transversely to the work axis X.

The third motor member 31 can be configured to activate each pincer 32 so that it retains the yarns F1, F2 in the operative position.

With reference to FIGS. 2-8, the retaining means 30 comprise one or more articulated arms 33 for each pincer 32, which are associated on one side with the third motor 31 and on the other side with the respective pincer 32.

The third motor member 31 can be configured to move the articulated arms 33 associated with each pincer 32 so as to take the respective pincer 32 into an operative position to retain the yarns F1, F2.

According to one embodiment, the joining device 10 comprises third sensor means 34 configured to detect the movement of the retaining means 30 from the operative position to the inactive position, and vice versa.

The third sensor means 34 can be, as a non-limiting example, of the magnetic and/or optical type.

By way of a non-limiting example (FIGS. 4-8), the third sensor means 34 can comprise two detection elements 34*b* provided on the third motor member 31, and one element 34*a* to be detected which is associated, for example, with the articulated arm 33 connected to the third motor member 31.

In particular, in this case the two detection elements 34*b* identify the inactive position and the operative position of the pair of pincers 32.

The control unit 29 can be configured to command the third motor member 31 as a function of the functioning parameters and of the values detected by the first sensor means 27, by the second sensor means 28 and by the third sensor means 34. In this way, it is possible to automate the tensioning and the maintenance of the yarns in the joining zone G.

According to one embodiment, the device 10 comprises a fourth motor member 40 configured to drive removal means 36 able to remove the end parts of the yarns F1, F2 not necessary for the joining.

In particular, the removal means 36 comprise a pair of gripping elements 37 disposed aligned with each other and opposite the joining zone G, preferably on both sides from which the yarns F1, F2 are fed toward the two components 11*a*, 11*b*.

The removal means 36 can comprise guide elements 38 associated with a respective gripping element 37.

In particular, these guide elements 38 are configured to move the respective gripping element 37 parallel to the work axis X.

According to one embodiment, the fourth motor member 40 is configured to move each gripping element 37 along the respective guide element 38 to the desired position in order to remove the end parts of the yarns F1, F2.

The fourth motor member 40 can also be configured to activate the pair of gripping elements 37 so as to grip the end part, to be removed, of the respective yarn and drag it along the guide element 38 so as to tear it by unthreading it.

The fourth motor member 40 can be derived from the third motor member 31.

The removal means 36 can be provided in correspondence with the pincers 32 of the retaining means 30, and can be configured to cooperate with the latter during the joining of the yarns F1, F2.

The device 10 can be provided with fourth sensor means 39 which detect the position of the gripping element 37 along the guide element 38.

Such fourth sensor means 39 can be, as a non-limiting example, of the magnetic, optical, induction and/or capacitive type.

The control unit 29 can be configured to move the pair of gripping elements 37 along the respective guide elements 38, by zoning the fourth motor member 40, as a function of the functioning parameters and of the values detected by the first, second, third and fourth sensor means 27, 28, 31, 40. In this way, it is possible to completely automate the joining of the yarns F1, F2, reducing the intervention of an operator to a minimum and optimizing the device 10.

Furthermore, the device 10 can provide at least one sensor for recognizing the yarn F1, F2 to be joined.

This recognition sensor can be optical and can detect the diameter of the yarn F1, F2 and the material which it consists of, and communicate these parameters to the control unit 29. The control unit 29 selects the functioning parameters of the device 10 suitable for the yarn to be joined thus identified.

According to one variant, the control unit 29 is suitable to dialog with a slubcatcher (not shown) located downstream of the device 10 in order to evaluate the joint obtained. If the slubcatcher is electronic, the dialogue can be reciprocal.

According to one variant, the device is equipped with detection means configured to detect at least the thickness of the yarn.

Such detection means can interact directly with the device 10, or through the control unit 29.

Such detection means can provide at least one sensor for verifying the joint carried out, as a non-limiting example, an optical sensor.

This verification sensor can detect, as a non-limiting example, the diameter, length, number of twists and compactness of the joint of yarn obtained.

In particular, the control unit 29 can compare these parameters detected by the verification sensor with the desired parameters pre-set in the memory 44, also considering possible tolerances. On the basis of this comparison, the control unit 29 can update and correct the functioning parameters of the device 10 pre-stored in the memory 44.

For example, moreover, the control unit 29 can communicate to an operator, by means of light and/or sound signals, an anomaly found in the joint just made or in the device 10.

Advantageously the control unit 29 is of the programmable type, able to control and command the device 10 in a dynamic and versatile manner, recognizing the type of yarns F1, F2 to be joined and evaluating the joint obtained in order to obtain the best possible result.

According to one embodiment, the device 10 is provided with a pair of cutting elements 35 configured to cut the end parts of the yarns to be joined.

In particular, the cutting elements 35 are protruding, in diametrical positions, from the frame 17 of at least one component 11*a*, 11*b*.

The cutting elements 35 can be selectively removable from the frame 17 so as to facilitate maintenance and replacement operations of the cutting elements 35 themselves.

According to one embodiment, the cutting elements 35 are configured to rotate integrally with the component 11*a*, 11*b* on which they are installed, and to cut the end parts of the yarns F1, F2 which are not necessary for the joining.

A cutting element 35 can be a blade, a cutting plate or a cutting element provided protruding from, and integral with, the frame 17, so as to intercept the yarn F1, F2 during the rotation of the components 11*a*, 11*b*.

According to one variant, a cutting element 35 can be provided on the first component 11*a* and another cutting element 35 can be provided on the second component 11*b* so as to cooperate with each other during the rotation as above.

Advantageously, this pair of cutting elements 35 is particularly efficient in the case of partly or totally elasticized textile yarns, since it cuts cleanly the end parts of the yarns F1, F2 preventing the use of the removal means 36 which would cause a stretching of the yarn and a loss of its elasticity.

A method for joining the opposite ends of two textile yarns F1, F2 can be obtained by means of decomposition and subsequently re-composition of the twists of the fibers of such ends, in order to make up a single yarn F.

In particular, with reference to FIGS. 4-8, the joining method comprises:

- introducing the two yarns F1, F2 to be joined between two components 11*a*, 11*b* in the joining zone G (FIG. 4*a*-4*c*) between the respective joining elements 12 facing each other aligned along a work axis X;
- bringing the two components 11*a*, 11*b* close to each other (FIG. 5*a*-5*c*) along the work axis X until there is at least partial contact between the facing joining elements 12;
- rotating the two components 11*a*, 11*b* (FIG. 5*a*-5*c*) in opposite directions to each other so as to bring the two yarns F1, F2 close and parallel to each other in the joining zone G;
- removing the end parts of the yarns F1, F2 (FIG. 6*a*-6*c*) which will not contribute to the joining, obtaining the two ends of the two yarns F1, F2 to be joined;
- bringing the ends of the two yarns F1, F2 to be joined close together until they substantially overlap;
- counter-rotating the two components 11*a*, 11*b* in opposite directions to each other so as to twist the opposite ends of the two yarns F1, F2 in order to create a single yarn F.

According to the invention, such method also comprises making available in an internal memory 44 of the control unit 29 a list of functioning parameters of the components 11*a*, 11*b* for joining textile yarns.

This control unit 29, as a function of the functioning parameters, commands and controls one or more motor members 13, 14, 31, 40 assigned to executing one or more of the steps as above.

In particular, in order to execute the steps as above, the two components 11*a*, 11*b* assume, in a relative manner with respect to each other, different work positions along the work axis X.

According to one embodiment, the method comprises detecting and monitoring the movement of at least one of the components 11*a*, 11*b* along the work axis X.

According to one embodiment, the method comprises detecting the rotation of at least one of the components 11*a*, 11*b* about the work axis X during the rotation and the counter-rotation.

Advantageously, the control unit 29 commands and controls the functioning of the components 11*a*, 11*b* on the basis of the functioning parameters stored in the internal memory 44, and on the basis of the parameters detected in the detections as above, automating and optimizing the joining of the yarns F1, F2.

Figures 5, 5A, 5B, 5C:
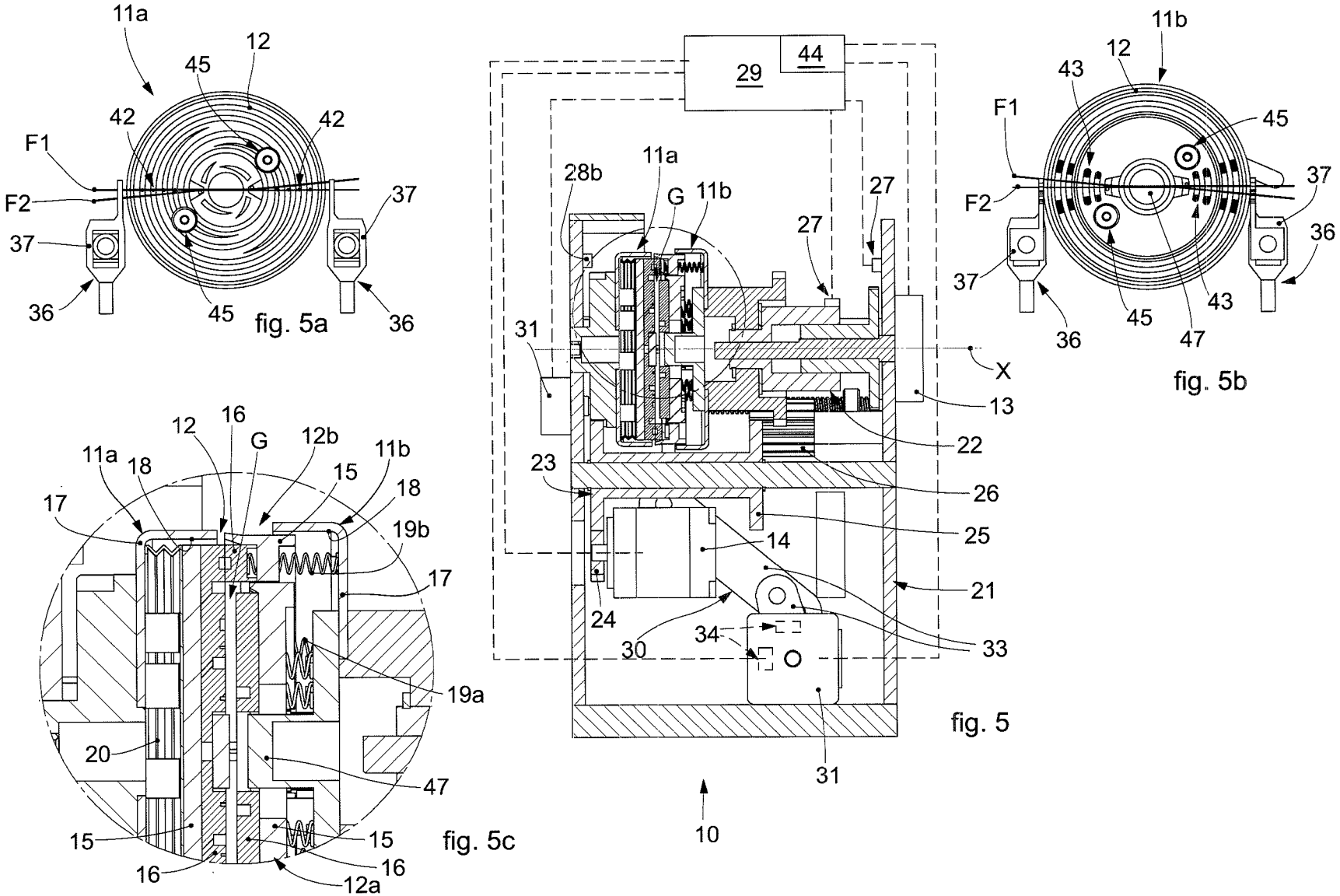

In particular, the first motor member 13 brings the two components 11*a*, 11*b* close to each other until there is contact between the joining element 12 of the first component 11*a* and the external annular joining element 12*b* of the second component 11*b* (FIG. 5*a*-5*c*).

This bringing together allows to diametrically clamp the two yarns F1, F2 between the joining element 12 of the first component 11*a* and the external annular joining element 12*b* of the second component 11*b*.

Once the yarns F1, F2 have been clamped between the two components 11*a*, 11*b*, the third motor member 31 can command the retaining means 30 to selectively clamp the yarns F1, F2 in position, externally to the components 11*a*, 11*b*. In the step of rotating the two components 11*a*, 11*b* in opposite directions with respect to each other, the second motor member 14 can command the rotation of the two components 11*a*, 11*b* in opposite directions, so as to bring the two yarns F1, F2 close and parallel to each other along the diameter identified by the joining element 12 and by the annular joining element 12*b* facing and cooperating with each other.

In particular, the command unit 29 commands and controls, during all the steps as above, the retaining means 30 in order to keep the yarns F1, F2 always in the correct tension inside the joining zone G.

The parallelization between the two yarns F1, F2 can be guided, in a known manner, by at least two or more pegs 41 provided protruding on both joining elements 12 so that, during the rotation, opposite pegs 41 align along the diameter as above drawing the two yarns F1, F2 along said position.

Figure 6B:
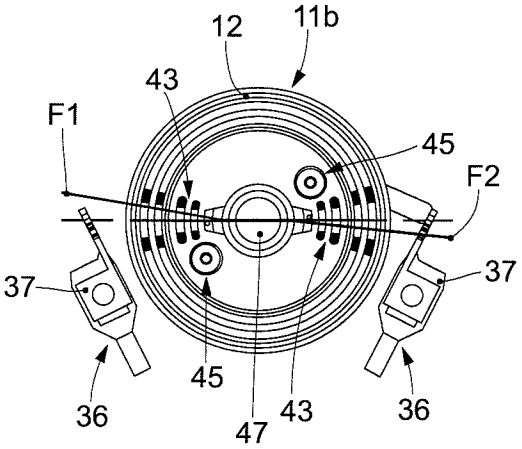
Figure 6:
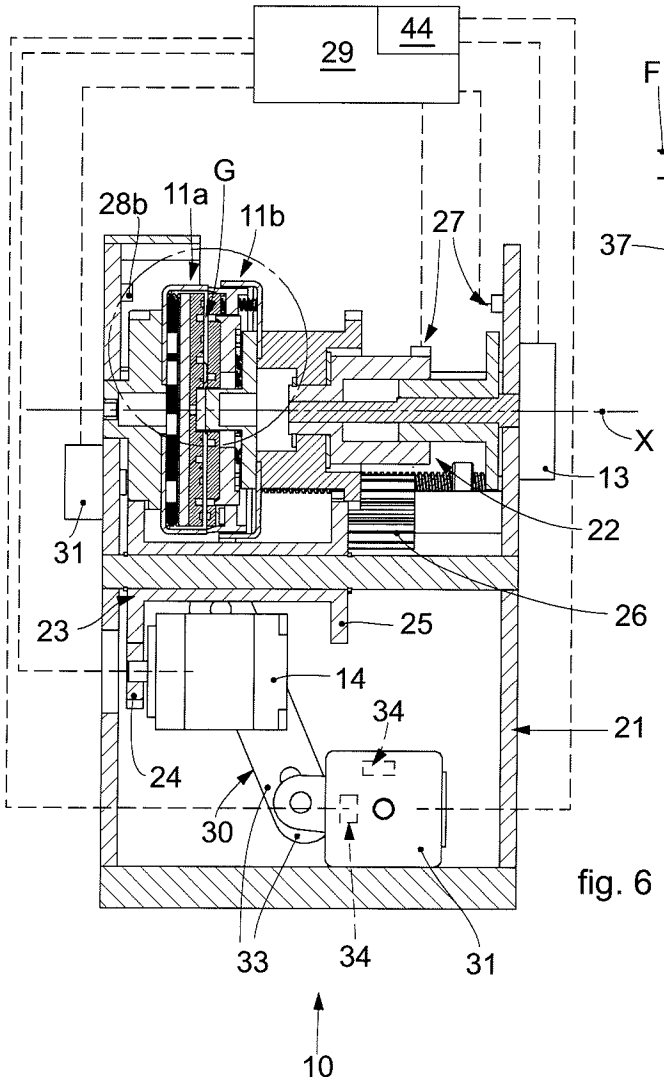
Figure 6A:
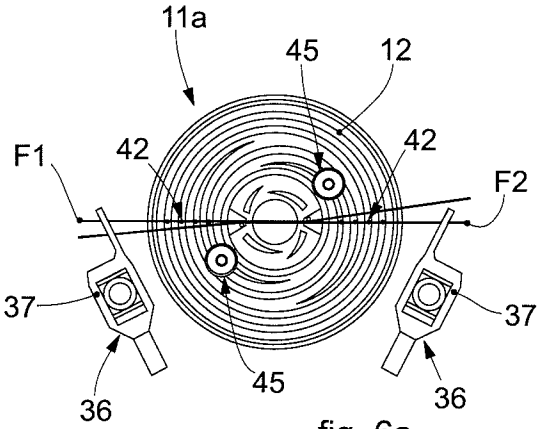
Figure 6C:
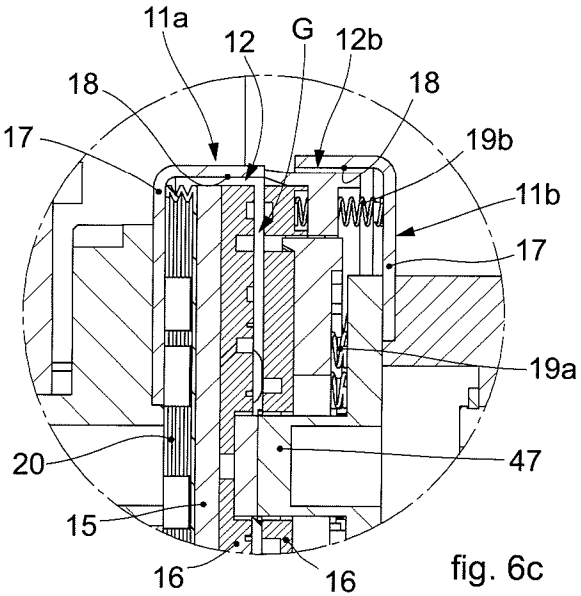

In particular, once the yarns have been parallelized in the joining zone G, the first motor member 13 can bring the two components 11*a*, 11*b* close to each other until there is contact between the joining element 12 of the first component 11*a* and the centering pin 47 of the second component 11*b*, so as to centrally constrain the two parallelized yarns F1, F2 between the two components 11*a*, 11*b* (FIGS. 6*a*-6*c*). In particular, in this position, in which the joining elements 12, 12*a*, 12*b* are not in contact, the end parts of the yarns are removed.

According to one embodiment, the removal is performed by cutting or, advantageously, by tearing.

In particular, in the case of tearing, after the rotation of the components 11*a*, 11*b*, the fourth motor member 40 drives the removal means 36 in order to tear the end part of the yarns F1, F2 exiting from the joining zone G.

In particular, in the case of cutting, the cutting elements 35, during the rotation, since they are integral with the frame 17, are disposed parallel to the yarns F1, F2, cutting the end part of the respective yarn F1, F2 exiting from the two components 11*a*, 11*b*.

With reference to FIG. 6*b*, the cutting elements 35 can cooperate with the gripping elements 37 so as to obtain a cleaner and more precise cut of the yarns F1, F2.

Figure 7B:
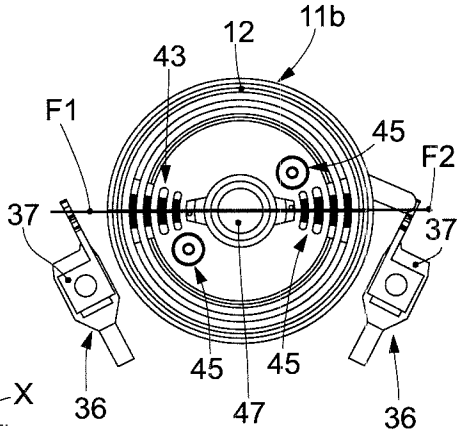
Figure 7:
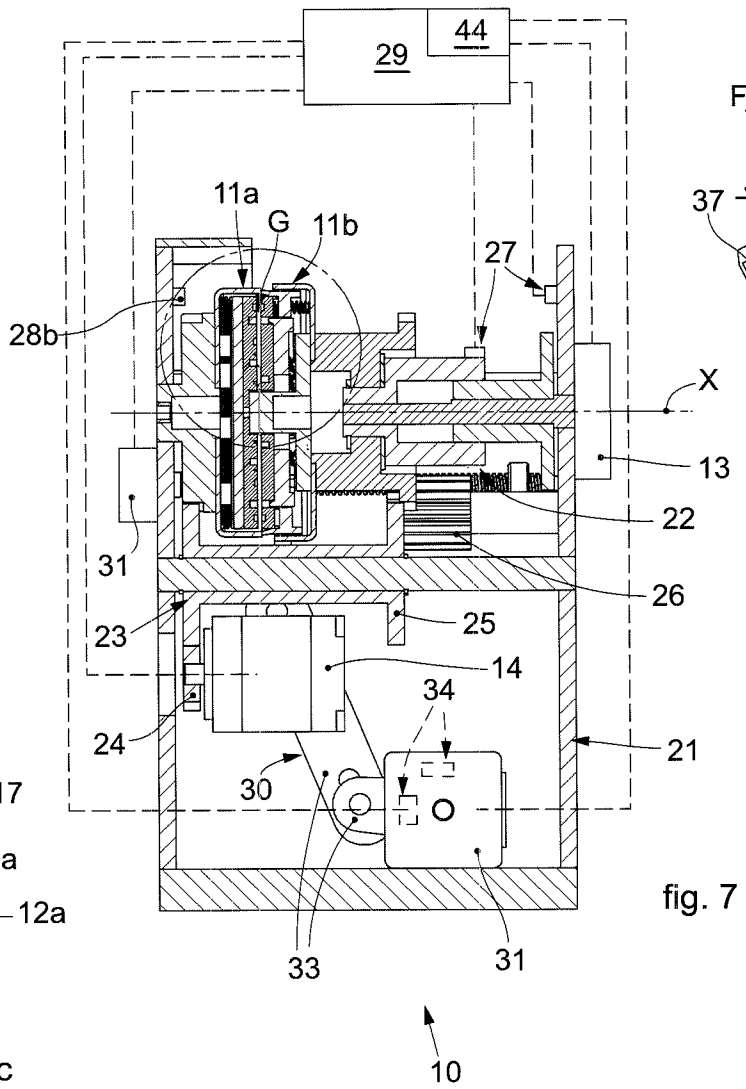
Figure 7A:
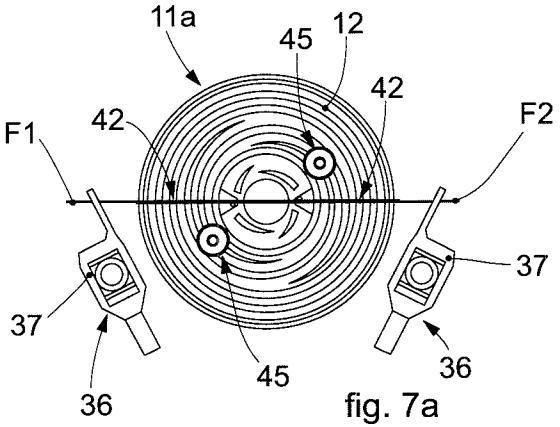
Figure 7C:
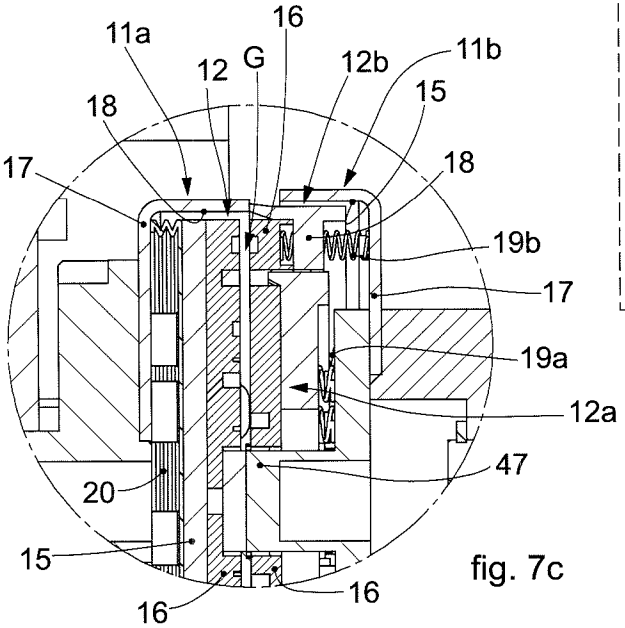

The step of bringing the two ends of the two opposite yarns F1, F2 close to each other can occur during and/or after the removal of the tails (FIGS. 7*a*-7*c*).

In particular, at least one of the two components 11*a*, 11*b* can provide gripping means 43 (FIG. 7*b*) configured to selectively protrude from the joining element 12 and to bring the ends of the yarns F1, F2 close to each other.

The gripping means 43 can have an automatic drive, following the rotation of the components 11*a*, 11*b*.

For example, the gripping means 43 can be driven by opposite levers which can be mechanically activated at the end of travel of the rotation of the respective component 11*a*, 11*b* on which they are installed.

According to one variant, the gripping means 43 can be commanded by a dedicated motor.

The gripping means 43 can comprise, as a non-limiting example, one or more pincers integral with the frame 17, provided inside the housing seating 18 and through in the thickness of the joining element 12.

In particular, such gripping means 43 are retracted in the thickness of the joining element 12.

For example, the pincers of the gripping means 43 protrude from the joining element 12, following its movement toward the inside of the housing seating 18.

According to one embodiment, at least one of the two components 11*a*, 11*b* can comprise a plurality of holes 42 provided at least on one component 11*a*, 11*b* and configured to introduce or suck air between the cooperating components 11*a*, 11*b* so as to bring the terminal ends of the two yarns F1, F2 close to each other and promote the twisting thereof.

Such holes 42 can be provided along the diameter of the joining element 12.

The holes 42 can be configured to cooperate with the gripping means 43 by introducing or, preferably, sucking air into the joining zone G in order to bring the two ends to be joined close together and compact them, so as to optimize the bringing together of the fibers of the ends of the two yarns F1, F2.

The control unit 29 can be configured to command a member for sucking/blowing air (not shown) coordinated with the functioning of the components 11*a*, 11*b* during the joining and configured to send/suck air, for example, through the holes 42.

In particular, the holes 42 can be provided on one component 11*a*, 11*b* and the gripping means 43 on the other component 11*a*, 11*b* facing it. In this way, the cooperation between the holes 42 and the gripping means 43 is more efficient.

By way of a non-limiting example, with reference to FIGS. 4*a*-8*a* and 4*b*-6*b*, the holes 42 can be provided on the joining element 12 of the first component 11*a*, and the gripping means 43 can be provided on the internal circular joining element 12*a* of the second component 11*b*.

Once the ends of the yarns F1, F2 have been brought close to each other, the first motor member 13 can command the bringing together of the components 11*a*, 11*b* so that the surfaces of the two opposite facing joining elements 12 are completely in contact. For example, in this case the gripping means 43 are hidden in the thickness of the corresponding joining element 12*a*, 12*b*.

Figure 8B:
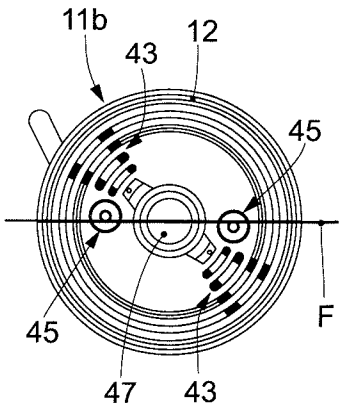
Figure 8:
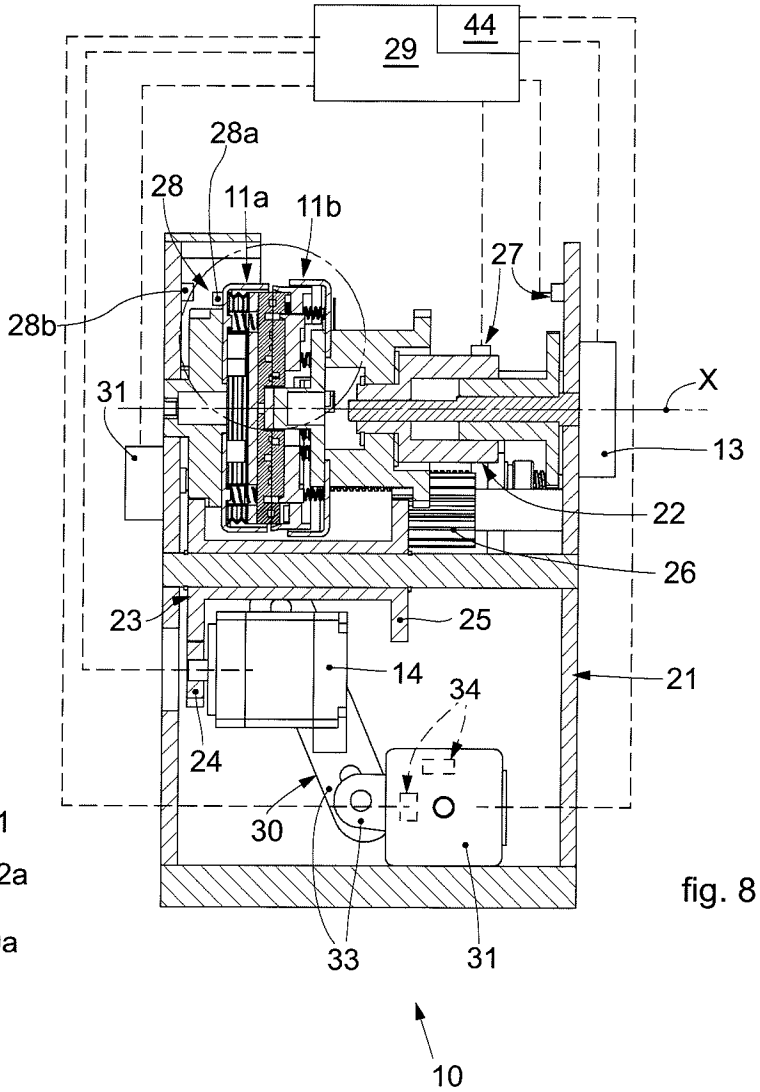
Figure 8A:
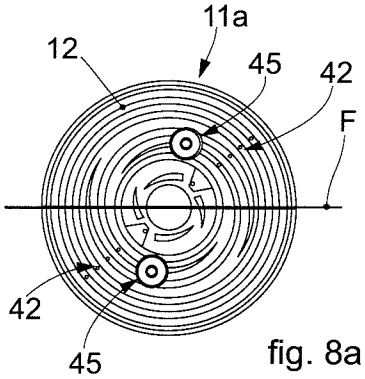
Figure 8C:
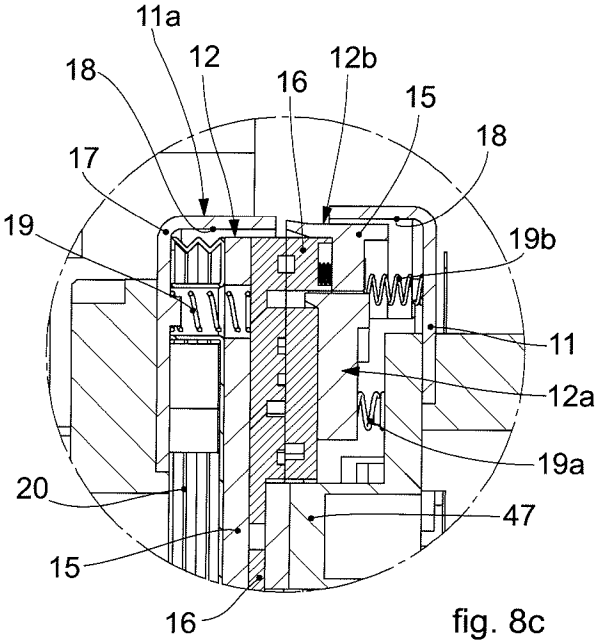

Subsequently, the control unit 29 commands the second motor member 14 to counter-rotate the two components 11*a*, 11*b* in opposite directions with respect to each other, and opposite with respect to the previous rotation, so as to twist the ends of the two yarns F1, F2 (FIGS. 8*a*-8*c*) with respect to each other.

The components 11*a*, 11*b* are then moved away from each other, by means of the first motor member 13, in order to extract the yarn F obtained.

FIG. 9 shows a variant of the present device 10, in which the motor member 13 can be a stepper motor, configured to translate at least one of the two components 11, 11*b* in one direction or the other, by means of the worm screw 48. Such worm screw 48 can be associated for example with the component 11*b*, which for this purpose will have a corresponding nut.

The motor member 13 can be equipped with a position transducer 49, as an alternative to or in combination with the first sensor means 27. Substantially, therefore, the present device 10 can comprise the first sensor means 27, the position transducer 49 or a combination of both.

The motor member 14, which commands the relative rotation of the two components 11*a*, 11*b*, can be a stepper motor equipped with a position transducer 50, as an alternative to or in combination with the second sensor means 28 which are configured to detect the angle of rotation of at least one of the components 11*a*, 11*b*. Substantially, therefore, the present device 10 can comprise the second sensor means 28, the position transducer 50 or a combination of both.

Figures 4, 4A, 4B, 4C:
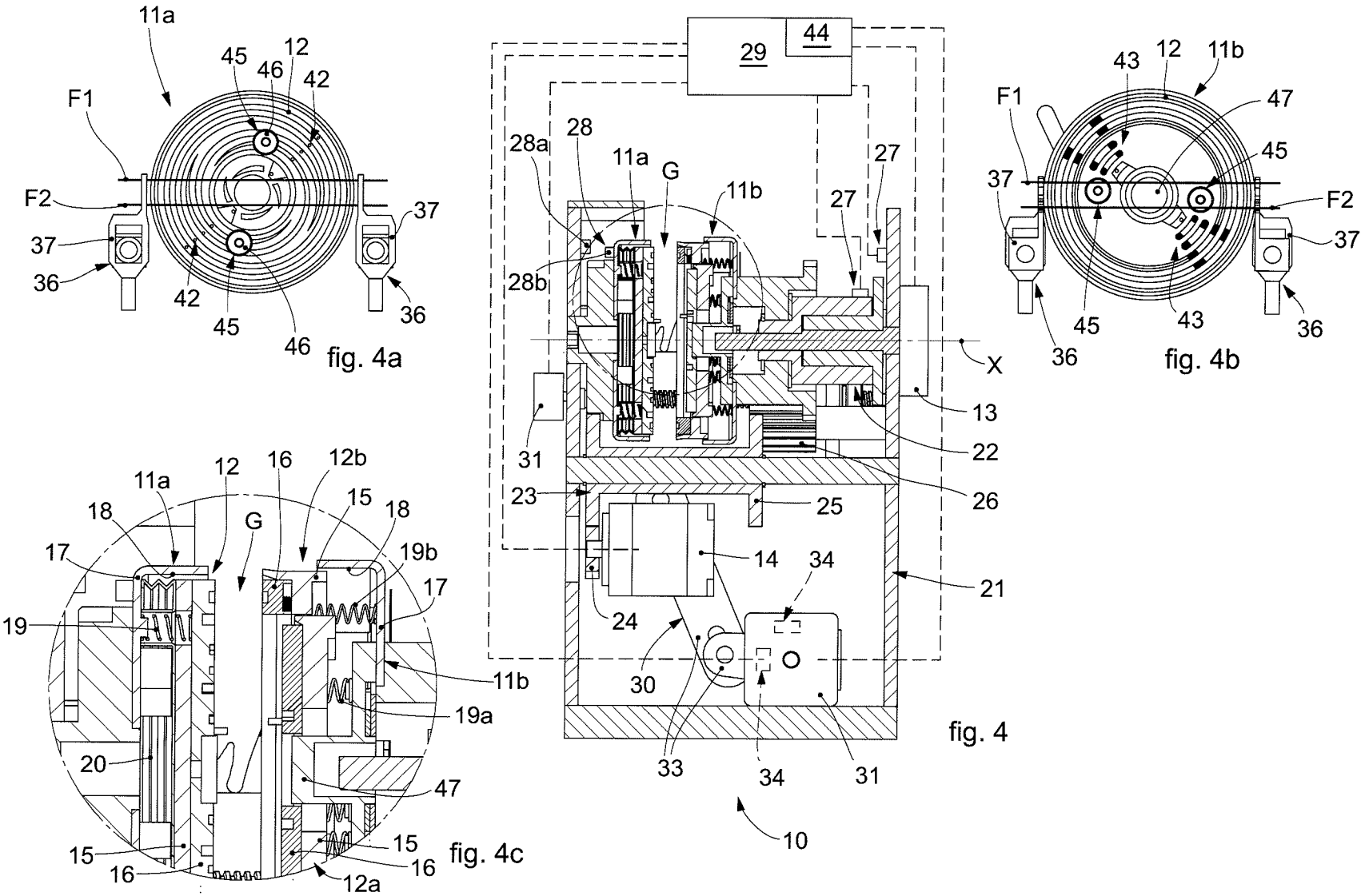

As seen in the variant of FIG. 4, the control unit 29 will be associated with the motor members 13 and 14 and configured to command the motor members 13 and 14 as a function of the functioning parameters and of the values detected by such position transducers 49 and 50, or encoders.

The position transducers could also be associated with other motor members present in the present device 10.

For example, the third motor member 31, configured to drive the retaining means 30 suitable to keep the yarns F1, F2 in tension in the joining zone G, could be equipped with a position transducer, or encoder.

The fourth motor member 40, configured to drive the removal means 36, could also be equipped with a position transducer, or encoder.

It is clear that modifications and/or additions of parts may be made to the joining device 10 as described heretofore, without departing from the field and scope of the present invention.

It is also clear that, although the present invention has been described with reference to some specific examples, a person of skill in the art shall certainly be able to achieve many other equivalent forms of device 10, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

The invention claimed is:

1. A joining device for joining opposite ends of two textile yarns by decomposition and subsequent re-composition of twists of fibers of the opposite ends in order to make a single yarn, the joining device comprising two counter-rotating components, each counter-rotating component of the two counter-rotating components being provided with at least one joining element and disposed opposite each other defining a joining zone between the joining elements facing each other and substantially aligned along a work axis, wherein the joining device comprises:

one or more motor members configured at least to selectively move at least one counter-rotating component of the two counter-rotating components along the work axis so as to adjust a width and size of the joining zone and to selectively rotate the two counter-rotating components with respect to each other about the work axis to obtain the decomposition and the subsequent re-composition of the twists of the fibers of the yarns;

a control unit having an internal memory provided with a list of functioning parameters of the two counter-rotating components for joining the yarns, the control unit being configured to control and command the one or more motor members based on the functioning parameters present in the internal memory, wherein one counter-rotating component of the two counter-rotating components provides grips configured to selectively protrude from the joining element and bring the two ends of the yarns to be joined close to each other, and in that the other counter-rotating component of the two counter-rotating components comprises a plurality of holes provided along a diameter of the joining element and configured to cooperate with the grips introducing air into or sucking air out of the joining zone in order to bring close together and compact two ends to be joined.

2. The joining device as in claim 1, wherein the functioning parameters comprise a speed of movement of the at least one counter-rotating component of the two counter-rotating components along the work axis, a rotation speed of the two counter-rotating components, the type of textile yarns to be joined, a thrust between the two counter-rotating components and/or a contact area in the joining zone between the joining elements.

3. The joining device as in claim 1, wherein the one or more motor members are electric of a stepper or brushless type.

4. The joining device as in claim 3, wherein at least one motor member of the one or more motor members is equipped with a position transducer, the control unit being configured to command the at least one motor member as a function of the functioning parameters and of values detected by the position transducer.

5. The joining device as in claim 1, further comprising a first sensor means configured to detect movement of the two counter-rotating components toward and/or away from each other, the control unit being configured to command the one or more motor members as a function of the functioning parameters and of values detected by the first sensor means.

6. The joining device as in claim 1, further comprising a second sensor means configured to detect an angle of rotation of at least one counter-rotating component of the two counter-rotating components, the control unit being configured to command the one or more motor member as a function of the functioning parameters and of values detected by the second sensor means.

7. The joining device as in claim 5, further comprising a first motor member of the one or more motor members configured to selectively move at least one counter-rotating component of the two counter-rotating components along said work axis and a second motor member of the one or more motor members configured to make the two counter-rotating components rotate with respect to each other, in opposite directions, about the work axis, the control unit being configured to command the first motor member and the second motor member as a function of the functioning parameters and of values detected by the first sensor means and second sensor means respectively.

8. The joining device as in claim 1, further comprising a third motor member configured to drive a pair of pincers suitable to keep the yarns in tension in the joining zone, the pair of pincers being mobile from an inactive position in which they do not interfere with the joining zone to an operative position on opposite sides of the joining zone in which the pair of pincers cooperate with the two counter-rotating components, the third motor member being at least configured to move the pair of pincers from the inactive position to the operative position.

9. The joining device as in claim 8, further comprising a third sensor means configured to detect a movement of the pair of pincers from the operative position to the inactive position and vice versa, the control unit being configured to command the third motor member as a function of the functioning parameters and of values detected at least by the third sensor means.

10. The joining device as in claim 1, further comprising a fourth motor member configured to drive removal means suitable to remove end parts of yarns not necessary for the joining, the removal means comprising a pair of gripping elements disposed aligned with each other and opposite the joining zone and respective guide elements associated with a respective gripping element and configured to move the respective gripping element parallel to the work axis, the fourth motor member being configured to move each gripping element along the respective guide element to a desired position in order to remove the end parts of the yarns.

11. The joining device as in claim 1, further comprising a pair of cutting elements provided protruding, in diametrical positions, from a frame of at least one counter-rotating component of the two counter-rotating components and selectively removable from the latter, the cutting elements being configured to rotate integrally with the one counter-rotating component and cut the end parts of the yarns not necessary for the joining.

12. A method for joining opposite ends of two textile yarns by decomposition and subsequently re-composition of twists of fibers of ends in order to make a single yarn, the method comprising:

introducing two yarns to be joined between two components, each of the two components provided with at least one joining element and disposed opposite each other defining a joining zone between the joining elements facing each other aligned along a work axis;

bringing the two components close to each other along the work axis until there is at least partial contact between the joining elements;

rotating the two components in opposite directions to each other so as to bring the two yarns close and parallel to each other in the joining zone;

removing the end parts of the yarns which will not contribute to the joining, obtaining the two ends of the two yarns to be joined;

bringing the ends of the two yarns to be joined close together until they substantially overlap;

counter-rotating the two components in opposite directions to each other so as to twist the opposite ends of the two yarns in order to create a single yarn;

wherein the method further comprises making available in an internal memory of a control unit a list of functioning parameters of the two components for joining textile yarns, wherein the control unit, as a function of the functioning parameters, commands and controls one or more motor members assigned to executing one or more steps of introducing the textile yarns into the joining zone, bringing the two components close together, rotating the two components, removing the end parts of the yarns, bringing the ends of the yarns obtained close together and counter-rotating the two components, wherein one of the two components provides grips configured to selectively protrude from the joining element and bring the ends of the two yarns to be joined close to each other, and in that the other of the two components comprises a plurality of holes provided along a diameter of the joining element and configured to cooperate with the grips introducing air into or sucking air out of the joining zone in order to bring close together and compact two ends to be joined.

13. The method as in claim 12, further comprising:

detecting and monitoring a movement of at least one of the two components along the work axis;

detecting the rotation of at least one of the two components about the work axis during a rotation and a counter-rotation;

wherein the control unit commands and controls the functioning of the one or more motor members on the basis of the functioning parameters stored in the internal memory and based on the parameters detected.

* * * * *